US010594037B1

(12) United States Patent
Wu et al.

(10) Patent No.: US 10,594,037 B1
(45) Date of Patent: Mar. 17, 2020

(54) DOUBLE TORSION COIL MAGNETIC CURRENT ANTENNA FEEDING STRUCTURE

(71) Applicant: The Chinese University of Hong Kong, Shatin (CN)

(72) Inventors: Ke-Li Wu, Shatin (CN); Zhen-Yuan Zhang, Changzhou (CN); Dacheng Wei, Guangzhou (CN)

(73) Assignee: The Chinese University of Hong Kong, Shatin, N.T., Hong Kong (CN)

( * ) Notice: Subject to any disclaimer, the term of this patent is extended or adjusted under 35 U.S.C. 154(b) by 39 days.

(21) Appl. No.: 16/139,535

(22) Filed: Sep. 24, 2018

(51) Int. Cl.
*H01Q 9/04* (2006.01)

(52) U.S. Cl.
CPC ..... *H01Q 9/0457* (2013.01); *H01Q 9/0464* (2013.01); *H01Q 9/0485* (2013.01)

(58) Field of Classification Search
CPC ... H01Q 9/0457; H01Q 9/0464; H01Q 9/0485
See application file for complete search history.

(56) References Cited

U.S. PATENT DOCUMENTS

| | | | |
|---|---|---|---|
| 6,593,887 | B2 | 7/2003 | Luk et al. |
| 6,995,713 | B2 | 2/2006 | Le Bolzer et al. |
| 7,119,746 | B2 | 10/2006 | Luk et al. |
| 8,373,597 | B2 | 2/2013 | Schadler et al. |
| 2010/0194643 | A1 | 8/2010 | Petros |

OTHER PUBLICATIONS

Barlately, et al., "Analysis of stacked microstrip patches with a mixed potential integral equation," IEEE Trans. Antennas Propag., vol. AP-38, pp. 608-615, 1990.
Brynjarsson et al. "Cavity-backed, aperture coupled microstrip patch antenna," IEE 1993 Int. Conf. Antennas Propagat. Symp. Proc., pp. 715-718.
Chair et al., "Miniature wideband half U-slot and half E-shaped patch antennas," IEEE Trans. Antennas Propag., vol. 53, No. 8, pp. 2645-2652, Aug. 2005.
Crog et al., "Large bandwidth aperture-coupled microstrip antenna," Electronics Lett., vol. 26, pp. 1293-1294, 1990.
Guo, et al., "L-probe proximity-fed annular ring microstrip Antennas," IEEE Trans on. Antennas and Propagation. vol. 49, No. 1, Jan. 2001, pp. 19-21.
Guo, et al., "Analysis and design of L-probe proximity fed-patch antenna," IEEE Trans. Antennas Propag., vol. 49, No. 2, pp. 145-149, Feb. 2001.

(Continued)

*Primary Examiner* — Graham P Smith
(74) *Attorney, Agent, or Firm* — Kilpatrick Townsend & Stockton LLP

(57) ABSTRACT

A magnetic current dipole feeding structure for patch and dielectric resonator antennas is disclosed in which a wire coil helix is placed above the ground plane and below the patch or top of the dielectric resonator block, the coil having half wound in a right-hand orientation and another half in a left-hand orientation, meeting at a common point in the middle. One end of the double torsion coil can be excited with radio frequency (RF) signals, and the other can be grounded on the ground plane. Some embodiments have the other end fed by an equal signal. These double torsion coils can be used in pairs to provide differential feeding to the patch or dielectric resonator, and pairs placed orthogonally to a first pair can be used for another polarization.

20 Claims, 16 Drawing Sheets

(56) References Cited

OTHER PUBLICATIONS

Huynh et al., "Single-layer single-patch wideband microstrip antenna," Electronics Lett., vol. 31, No. 16, pp. 1310-1312, 1995.
Lai et al., "Design and study of wide-band patch antenna fed by meandering probe," IEEE Trans. Antennas Propag., vol. 54, No. 2, pp. 564-571, Feb. 2006.
Lai et al., "Wideband patch antenna fed by printed meandering strip," Microwave and Opt. Tech. Lett., vol. 20, No. 4, pp. 256-257, 2008.
Lee, et al., "Characteristics of a two-layer electromagnetically coupled rectangular patch antenna," Electronics Lett., vol. 23, No. 20, pp. 1070-1073, 1987.
Lee, et al., "Studies of stacked electromagnetically coupled patch antenna," Microwave and Opt. Tech. Lett., vol. 8, No. 4, pp. 212-215, 1995.
Lee, et al., "The versatile U-slot patch antenna," IEEE Antennas and Propagation Magazine, vol. 52, pp. 71-78, 2010.
Luk, et al., "Broadband microstrip patch antenna," Electronics Lett., vol. 34, pp. 1442-1443, 1998.
Mak, et al., "Experimental study of a microstrip patch antenna with an L-shaped probe," IEEE Trans. Antennas Propag., vol. 48, No. 5, pp. 777-783, May 2000.
Mak, et al., "High-gain and wide-band single-layer patch antenna for wireless communications," IEEE Trans. Vehicular Tech., vol. 54, No. 1, pp. 33-40, Jan. 2005.
Pozar, "Microstrip antenna aperture-coupled to a microstripline," Electronics Lett., vol. 21, pp. 49-50, 1985.
Schaubert, et al., "Effect of microstrip antenna substrate thickness and permittivity: comparison of theories with experiment," IEEE Trans. Antennas Propag., vol. 37, No. 6 pp. 677-682, Jun. 1989.
Tong, et al., "A broadband U-slot rectangular patch antenna on a microwave substrate," IEEE Trans. Antennas Propag., vol. 48, No. 6, pp. 954-960, Jun. 2000.
Tulintseff, et al., "Input impedance of a probe-fed stacked circular microstrip antenna," IEEE Trans. Antennas Propag., vol. AP-39, pp. 382-390, 1991.
Wood, "Improved bandwidth of microstrip antenna using parasitic elements," IEE Proc., Pt. H, vol. 127, pp. 231-234, 1980.

DOUBLE TORSION COIL MAGNETIC CURRENT ANTENNA FEEDING STRUCTURE

CROSS-REFERENCES TO RELATED APPLICATIONS

NOT APPLICABLE

STATEMENT AS TO RIGHTS TO INVENTIONS MADE UNDER FEDERALLY SPONSORED RESEARCH AND DEVELOPMENT

NOT APPLICABLE

BACKGROUND

1. Field of the Invention

The present application generally relates to resonant-type antennas having dimensions not more than one operating wavelength and consisting of radiating elements, such as patch and dielectric resonator antennas, that are electromagnetically coupled to feeding structures. Specifically, the application is related to such antennas with an innovative feed probe, the feed probe including a coil that reverses direction along its length in order to maximize magnetic coupling with the radiating element.

2. Description of the Related Art

Broadband low-profile antennas are widely used in today's wireless communication systems, including conformal antennas on aircraft, large scale scanning arrays, and low profile antenna arrays for cellar wireless systems. For upcoming 5G communications, as the Massive Multiple Input Multiple Output (M-MIMO) antennas becomes one of the key technologies, a large amount of broadband dual linearly polarized antennas may be required to form a large-scale array antenna.

From the equivalence principle point of view, antenna feeding schemes usually can be divided into two types, electric current feeding and magnetic current feeding. In a typical electric current feeding scheme for broadband applications, it is usually difficult to achieve a low profile and low cross polarization. An example of a wide band electric current feeding scheme is the "L" shaped feeding probe.

A magnetic current feeding scheme creates an equivalent horizontally-placed magnetic current above the ground plane. The most common way to create a magnetic current is to create tangential electric field across an aperture on the antenna's ground plane. An aperture coupled patch antenna is one of few ways to feed an antenna using magnetic current. A typical issue for the aperture-coupling method is the back-lobe radiation. To overcome this shortcoming, the cavity-backed version of the aperture coupling method is an option if the cost and complexity are not a major concern.

In U.S. Pat. No. 6,593,887 B1, issued Jul. 15, 2003 to Luk et al., a wideband patch antenna was introduced that consisted of an "L" shaped probe and a rectangular patch. The dimensions of the probe are chosen in the way that the inductive reactance of one portion is cancelled by the capacitive reactance of rest of portion.

In U.S. Pat. No. 7,119,746 B2, issued Oct. 10, 2006 to Luk et al., an antenna comprises a patch spaced from a ground plane, with the patch being substantially parallel with said ground plane, and a feed probe located between the patch and the ground plane. The feed probe comprises at least two portions parallel to the patch but spaced by different distances from the patch.

In U.S. Patent Application Publication No. US 2010/0194643 A1, published Aug. 5, 2010 for Petros, a wideband patch antenna with a helix-shaped probe was introduced. The wideband patch antenna is presented that comprises a patch which may be of pure metallic form or may be etched on a dielectric, that may be rectangular, elliptical, triangular, or any other geometric shape. The patch is disposed a distance above a ground plane and is driven by a helix shaped or meandering probe disposed between the patch and the ground plane. The probe is substantially normal to the ground plane. In addition, a plurality of such patch antennas may be combined to form antenna arrays or a dual-band antenna structure.

In U.S. Pat. No. 8,373,597 B2, issued Feb. 12, 2013 to Schadler, a microstrip patch antenna having a high gain and wide band was disclosed. The microstrip patch antenna includes a patch antenna layer and two parasitic elements layers. The parasitic elements are electrically coupled with the patch antenna layer, which are used to broaden the impedance bandwidth of the patch antenna.

In U.S. Pat. No. 6,995,713 B2, issued Feb. 7, 2006 to Le Bolzer et al., a wideband antenna consisting of a dielectric resonator mounted on a substrate with a ground plane was proposed. A slot is cut upon the ground plane, which is used to create a magnetic current to excite the dielectric resonator antenna.

In Yong-Xin Guo, Kwai-Man Luk and Kai-Fong Lee, "L-probe proximity-fed annular ring microstrip Antennas," *IEEE Trans on. Antennas and Propagation*. Vol. 49, No. 1, January 2001, pp. 19-21., a wideband annular ring microstrip antenna is disclosed. The annular ring antenna comprises a single-layer annular ring microstrip antenna with a foam substrate and an L-shaped feeding probe. A broadband characteristic can be achieved by capacitive coupling between the L-probe and the annular ring microstrip antenna.

There is a need in the art for alternate methods of feeding patch and dielectric resonator antennas to allow for low profiles and wide bandwidths.

BRIEF SUMMARY

Generally, a wire coil that is wound one way halfway along its length and then reverses its winding 'handedness' for the other half is suitable as a magnetic-current feeding structure for a patch or dielectric resonator antenna. The coil can be referred to as a "double torsion coil (DTC)". The length of the double torsion coil is on the order of half a wavelength $\lambda$ of the antenna, and its axis is parallel to the plane of a patch or top of a dielectric resonator, which is also parallel to a ground plane. One end of the coil is excited by a signal, and the other end is either grounded or subject to a signal with equal phase and magnitude.

Two sets of double torsion coils can operate on opposing sides of the antenna to differentially feed a patch or dielectric resonator. Alternatively, or in conjunction, an orthogonal set of double torsion coils can feed the antenna in complementary polarizations.

Some embodiments of the present invention are related to an antenna apparatus having a magnetic-current feeding structure. The apparatus includes a ground plane, a top face at a fixed height from the ground plane and configured for radiating at an operating wavelength $\lambda$, a conductive wire helix having an axis parallel with the ground plane, the helix located at a height below the top face and above the ground plane, the helix having one half coiled in a right-handed direction and another half coiled in a left-handed direction, the halves connected with each other at a middle point of the helix, and an excitation stub connected with an end of the conductive wire helix, the excitation stub configured for connecting with an excitation source.

The apparatus can further include a ground stub connecting an end of the conductive wire helix that is opposite the excitation sub to the ground plane. Or the apparatus can include a dual feed stub that is configured to connect an end of the conductive wire helix that is opposite the excitation stub with the excitation source.

The conductive wire helix can be a first conductive wire helix of a differential feed pair, and the apparatus can further include a differential conductive wire helix having an axis parallel with the ground plane and parallel to the axis of the first conductive wire helix, the differential helix having one half coiled in a right-handed direction and another half coiled in a left-handed direction, the halves of the differential helix connected with each other at a middle point of the differential helix. The first conductive wire helix and the differential conductive helix can form a first differential feed pair, and the apparatus can further include a perpendicular differential feed pair comprising a pair of conductive wire helixes each having an axis parallel with the ground plane and perpendicular to the axis of the first conductive wire helix (and first differential feed pair), each having one half coiled in a right-handed direction and another half coiled in a left-handed direction.

The conductive wire helix can be a first conductive wire helix of a dual polarized feed, and the apparatus can further include a perpendicular conductive wire helix having an axis parallel with the ground plane and perpendicular to the axis of the first conductive wire helix, the perpendicular helix having one half coiled in a right-handed direction and another half coiled in a left-handed direction, the halves of the perpendicular helix connected with each other at a middle point of the perpendicular helix.

The apparatus can further include a rectangular or square conductive patch, wherein the top face is a surface of the conductive patch. The helix axis can be parallel with a straight edge of the patch. The conductive wire helix axis can be located within 0.05λ inside a right angle projection of the straight edge.

The apparatus can further include a dielectric block extending from the ground plane to the conductive patch. The conductive wire helix can be embedded within the dielectric block.

The apparatus can further include a conductive annular ring, wherein the top face is a surface of the annular ring. The apparatus can further include a dielectric block extending from the ground plane to the conductive annular ring. The apparatus can further include a dielectric resonator, wherein the top face is a surface of the dielectric resonator.

The height of the helix axis above the ground plane can be less than 0.04λ. A number of turns N of each half of the helix can be 2, 2½, 3, 3½, 4, 4½, or 5. A radius b of the helix can be less than 0.01λ. A maximum stretch length of the helix can be within ±10% of λ/2. The phrase "configured for connecting with an excitation source," mentioned above, can include passing to an opposite side of, but not being electrically connecting with, the ground plane. The apparatus can further include an excitation source connected with the excitation stub. There can be an array of antenna apparatuses.

Some embodiments are related to a method of manufacturing an antenna apparatus having a magnetic-current feeding structure. The method includes providing a top face that is at a fixed height from a ground plane and configured for radiating at an operating wavelength λ, coiling a first portion of a wire in a right-handed direction and a second portion of the wire in left-handed direction to form a conductive wire helix in the wire, bending an end of the wire to form an excitation stub, the coiled and bent wire forming a double torsion feeding structure, placing the conductive wire helix of the double torsion feeding structure at a height below the top face and above the ground plane, and passing the excitation stub to an opposite side of, but not electrically connecting with, the ground plane.

The method can further include bending an end of the wire that is opposite the excitation stub to form a ground stub, and soldering the ground stub to the ground plane. The method can further include bending an end of the wire that is opposite the excitation stub to form a dual feed stub.

The double torsion feeding structure can be a first double torsion feeding structure, and the method can further include positioning a second double torsion feeding structure at the height below the top face and above the ground plane, and passing an excitation stub of the second double torsion feeding structure to the opposite side of, but not electrically connecting with, the ground plane. The method can further include forming or attaching a conductive patch or a conductive annular ring on a dielectric block, and affixing the dielectric block to the ground plane, wherein the top face is a surface of a rectangular or square conductive patch or a surface of a conductive annular ring. The method can further include embedding the double torsion feeding structure within the dielectric block. The method can further include affixing a dielectric resonator to the ground plane.

A height of an axis of the helix above the ground plane can be less than 0.04λ. A number of turns N of each portion of the helix can be 2, 2½, 3, 3½, 4, 4½, or 5. The method can further include connecting the excitation stub to an excitation source.

Some embodiments are related to a method of magnetically feeding an antenna having a nominal operating wavelength of λ. The method includes passing a current through a conductive wire helix located at a height below a top face and above a ground plane, the helix having one half coiled in a right-handed direction and another half coiled in a left handed direction, the halves connected with each other at a middle point of the helix, generating, by way of the passing of the current, a magnetic current dipole in one half of the helix and a magnetic current dipole in the other half of the helix, the magnetic current dipoles constructively interfering to form a driving magnetic current dipole between the top face and the ground plane, and coupling the driving magnetic current dipole with a material or other radiating element forming the top face to create radiating magnetic currents in the radiating element.

The current can be a first current, and the conductive wire helix can be a first conductive wire helix of a differential feed pair. The method can further include passing a differential current through a differential conductive wire helix having an axis parallel with the ground plane and parallel to an axis of the first conductive wire helix, wherein the differential current is at a same magnitude but opposite phase as the first current. The first conductive wire helix and the differential conductive helix can form a first differential feed pair. The method can further include passing a second current through a perpendicular differential feed pair that is parallel with the ground plane and perpendicular to the first differential feed pair. The conductive wire helix can be a first conductive wire helix of a dual polarized feed. The method can further include passing a second current through a perpendicular conductive wire helix that is perpendicular to the first conductive wire helix. The radiating element can be a rectangular or square conductive patch or a conductive annular ring. The radiating element can be a dielectric resonator. A height of an axis of the helix above the ground plane can be less than 0.04λ. A number of turns N of each half of the helix can be 2, 2½, 3, 3½, 4, 4½, or 5.

DETAILED DESCRIPTION

A new type of magnetic current antenna feeding structure is proposed, namely a double torsion coil (DTC) feeding structure, for many commonly used antennas, such as patch antennas, dielectric resonator antennas, and annular ring patch antennas. A double torsion coil can be used by short-circuiting one end to ground and exciting the other end by a coaxial probe. The maximum stretch length of the conducting coil is around half a wavelength at the center frequency. It can be called double torsion coil because its winding directions, i.e., handedness, of the first half and that for the second half of the coil are opposite. Having wound in two opposite directions, the two half coils produce two in-line equivalent magnetic currents that are tangential to and above the ground plane in the same direction. The superposition of the two magnetic currents makes them constructively interfere to form a driving magnetic current for the patch or dielectric resonator.

FIGS. 1A-1E illustrate a double torsion coil patch antenna in accordance with an embodiment. Antenna assembly 100 comprises copper patch 103 fixed above ground plane 102 and one double torsion coil (DTC) 106 underneath the patch for linearly polarization. The top surface of the patch is top face 104. The patch is sized and fixed above the ground plane so that it is optimized for radiating at a nominal frequency or range of frequencies.

For the patch antenna, at least one operating wavelength λ is associated with the nominal frequency or range of frequencies of the antenna.

Figure 1A:
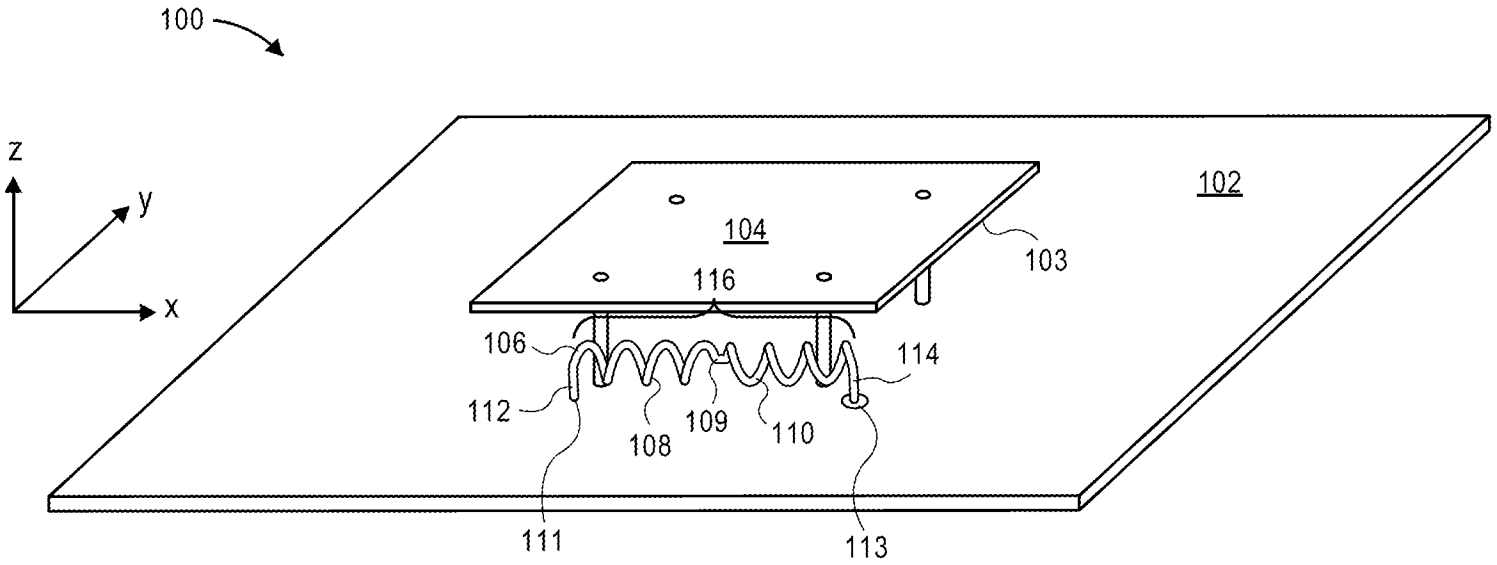
FIG. 1A is an isometric view of a double torsion coil patch antenna in accordance with an embodiment.
Figure 1B:
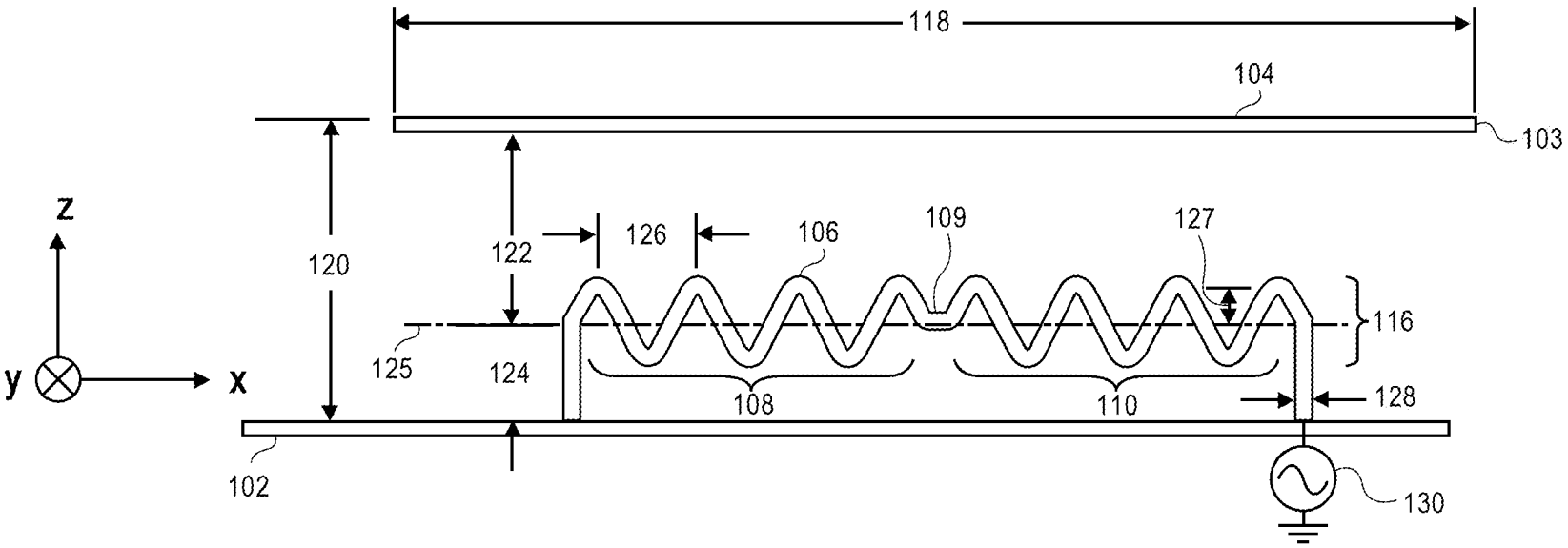
FIG. 1B is a front view of the double torsion coil patch antenna of FIG. 1A.
Figure 1C:
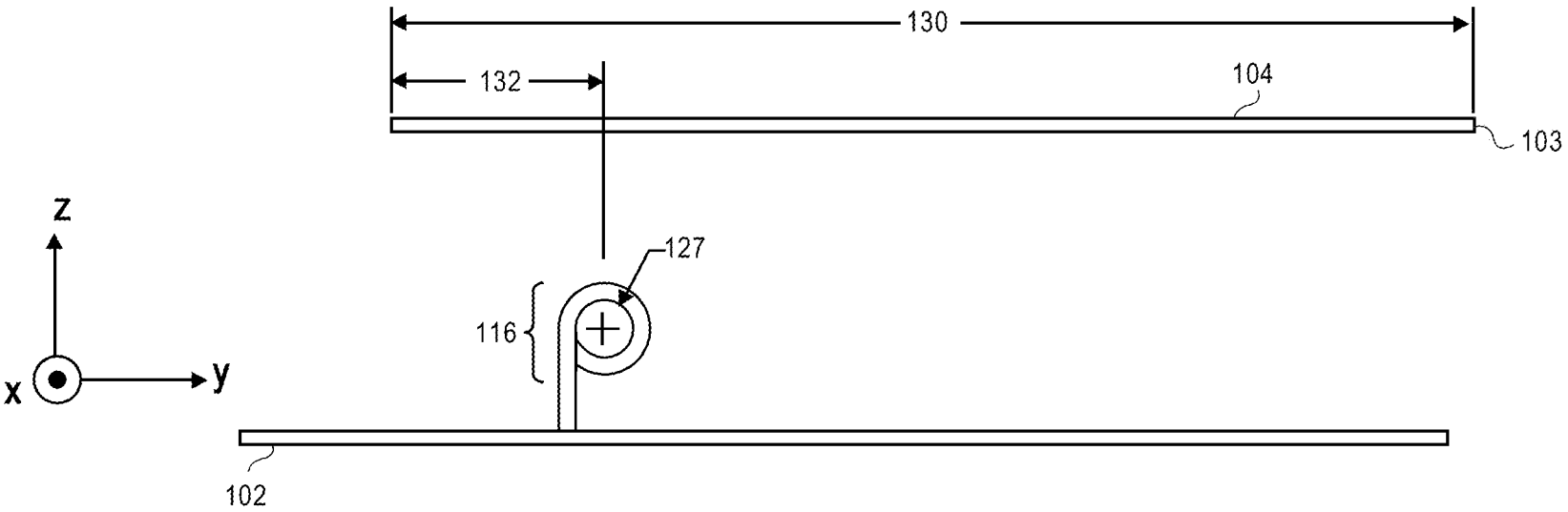
FIG. 1C is a side view of the double torsion coil patch antenna of FIG. 1A.

FIGS. 1B-1C illustrate the configuration of the double torsion coil feeding structure for the singly fed linearly polarized patch antenna. Patch antenna 103, with top face 104, has length 130 and width 118. Top face 104 of the patch antenna is placed height 120 above ground plane 102. The feeding double torsion coil probe is grounded at one end and excited at the other end.

Double torsion coil 106 includes a conductive, copper wire in which a portion has been wound into helix 116. Other electrically conductive metals or materials can be used. In the exemplary embodiment, half 108 of wire helix 116 is coiled in a left-handed helix around axis 125. Other half 110 of wire helix 116 is coiled in a right-handed helix around axis 125. The halves connect with each other at middle 109. Middle 109 is not along axis 125 but rather at the radius. Some configurations can join the left- and right-handed helixes at a point on the axis.

The conductive wire has a gauge or diameter 128. Helix 116 has an inner radius of 127 and pitch of 126. The pitch is the number of turns per unit length. The number of turns N of each half coil 108 and 110 is selected as 3.5 in this embodiment.

Both ends of the conductive wire are bent downward toward the ground plane. One end, ground stub 112 (FIG. 1A), is soldered at port 111 to ground plane 102 and is thus grounded. The opposite end, excitation stub 114, passes through a through hole in ground plane 102 at port 113, without being electrically connected to the ground plane, in order to connect with alternating current (AC) voltage source 130. Voltage source 130 and its associated circuitry drive voltages and electrical currents through the coil, producing a magnetic current to drive the antenna.

A "half" includes not just exactly ½ of something but rather a broader definition that approximates a half and is less mathematically exacting, or as otherwise known in the art. For example, a half can be a portion ±1%, ±5%, ±10%, ±15%, ±20%, ±25%, ±30%, or other tolerance around 50%.

Similarly, a "middle" includes not just exactly in the center or middle of something but approximates a central area or region and is less mathematically exacting, such as with the tolerances above, or as otherwise known in the art.

A "height" above a ground plane are not limited to a distance in line with respect to the center of the Earth or an altitude but rather can be any distance projecting normal from the ground plane, or as otherwise known in the art.

The distance between axis 125 of helix 116 and ground plane 102 is height 124. The coil is located at the middle of and inset distance 132 (FIG. 1C) inward, or in some embodiments outward, from one radiating edge of the patch antenna. Distance 132 can be very small. That is, distance 132, which is from axis 125 to a right angle projection of a straight edge of the patch, can be equal-to-or-less-than 0.15λ, 0.10λ, 0.05λ, 0.04λ, 0.03λ, 0.02λ, or 0.01λ in some configurations.

Figure 1D:
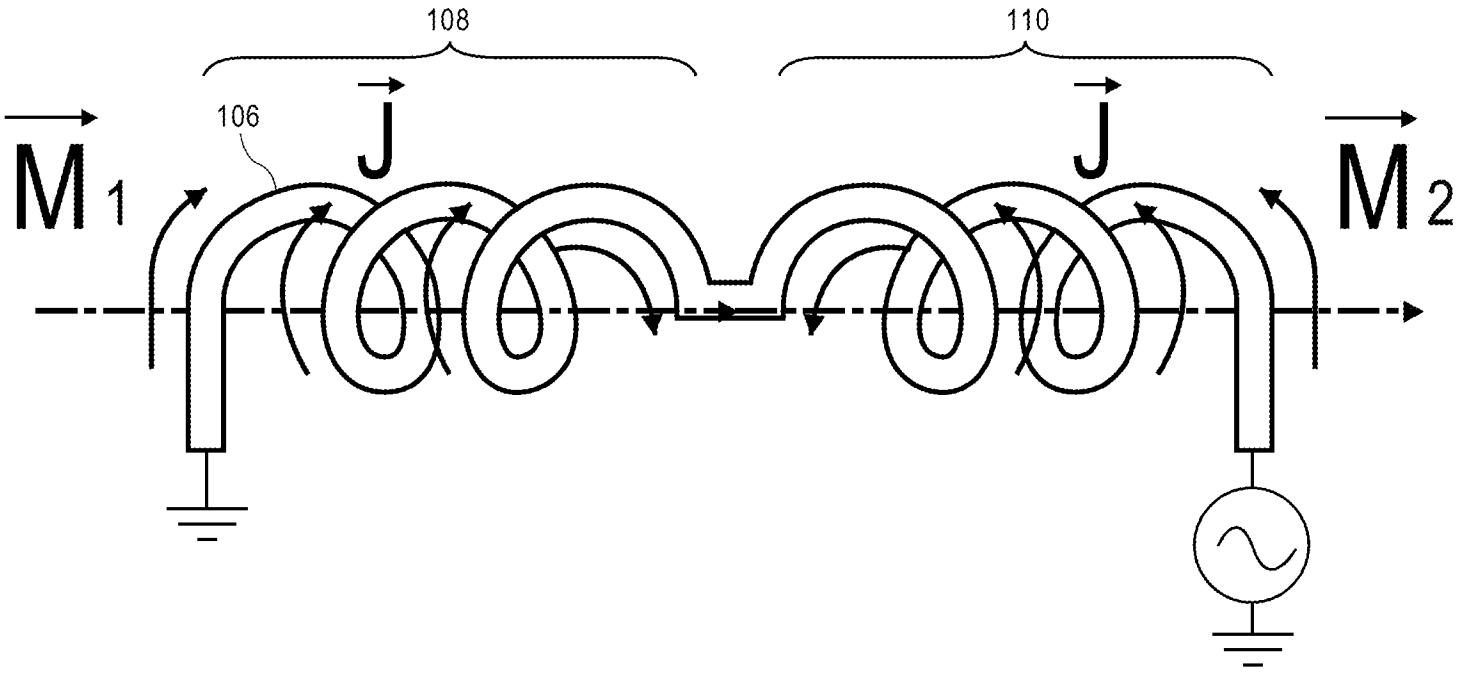
FIG. 1D is a schematic of the double torsion coil of FIG. 1A with electromagnetic field lines.
Figure 1E:
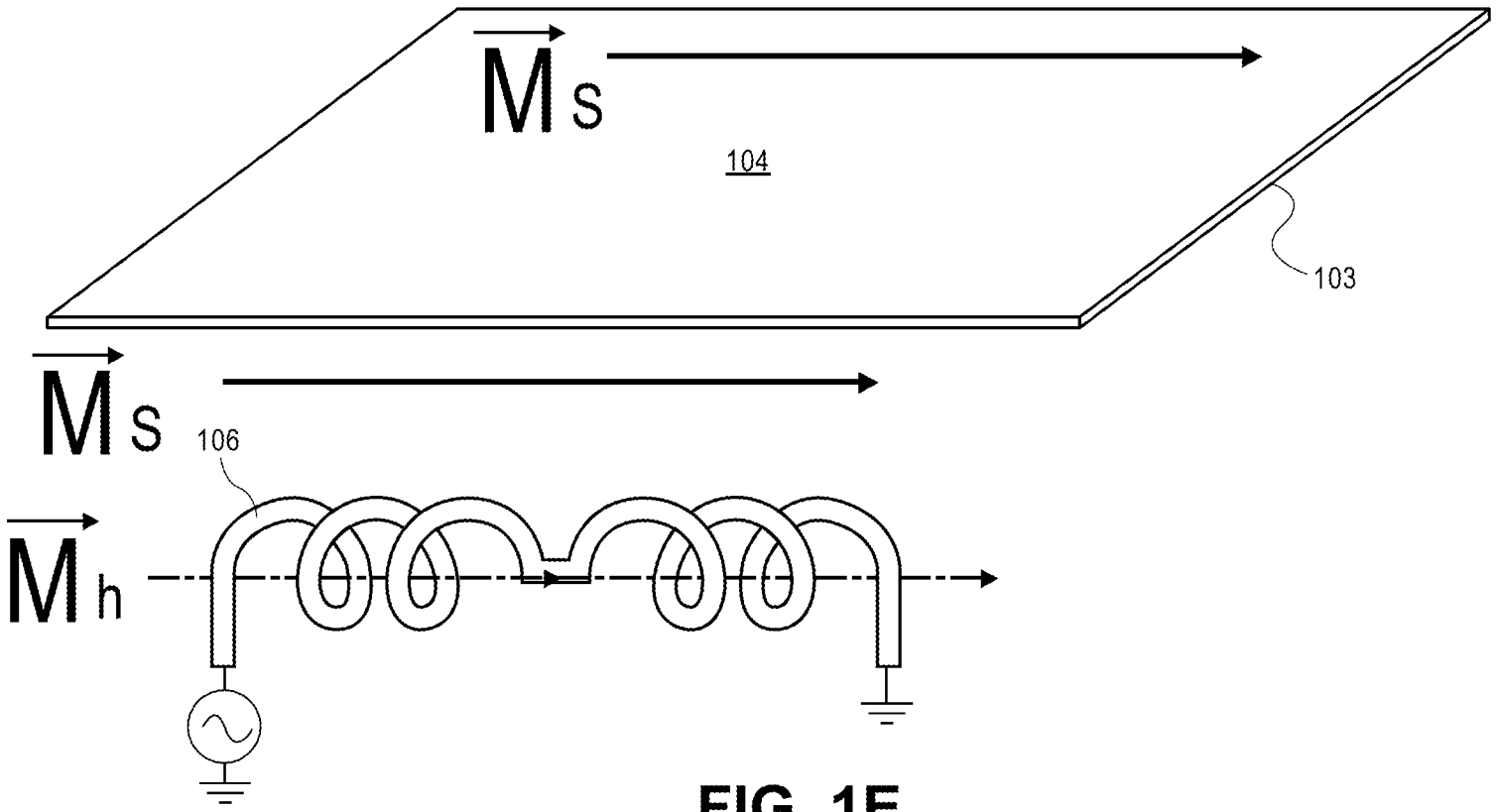
FIG. 1E is a 3D schematic of the double torsion coil of FIG. 1A interacting with a patch.

FIGS. 1D-1E illustrate the equivalent magnetic current in a double torsion coil and the induced equivalent magnetic currents along the radiating edges of a patch antenna in order to show a theoretical working mechanism of the double torsion coil of FIG. 1A.

If the coil, grounded at one end, were replaced by a straight conductive wire with a total length of $\lambda_0/2$, where $\lambda_0$ is the free-space wavelength at the resonant frequency, then a resonating electric current would emanate from each end toward the center of the wire, meeting at the middle. At the middle there is a current null, at which the direction of the electric current is reversed.

If the straight wire is wound in one direction to form an ordinary coil, then the direction of the current along the wire will be reversed in the middle. That is, the electric current would loop around the wire but would experience a null in the middle. This would lead to two same-magnitude but opposite-directed equivalent magnetic current dipoles. The contributions of the two magnetic current dipoles cancel each other, such that they destructively interfere. The direction of the equivalent magnetic current dipole created by a coil depends on three factors: the number of turns, the direction of the current along the helical wire, and the winding direction of the coil.

Now back to double torsion coil 106 in the figures in which the winding directions of the first half and the second half of the coil are opposite. Passing a current J through the two halves 108 and 110 of the coil results in a magnetic current dipole $M_1$ through half 108 and another magnetic current dipole $M_2$ in half 110. Instead of canceling each other out as in a normal coil, $M_1$ and $M_2$ constructively interfere with each other because they are aligned in the same direction. Their superposition forms a driving magnetic current dipole $M_h$ (FIG. 1E). This driving magnetic current dipole is located between the patch 103 (and its top face 104) and the ground plane.

A rectangular patch antenna can be described by two radiating magnetic currents $M_s$ located at the two radiating edges. The driving magnetic current dipole $M_h$ created by the coil can be naturally coupled with a radiating magnetic current of the patch. For a horizontally placed magnetic current above the ground plane, its mirror image magnetic current will be in the same direction. Thus, by choosing the maximum stretch length of the coil approximately to be $\lambda_0/2$, the DTC feeding structure acts as a magnetic current dipole antenna in free space, creating a resonant driving source to the patch antenna.

Figure 2:
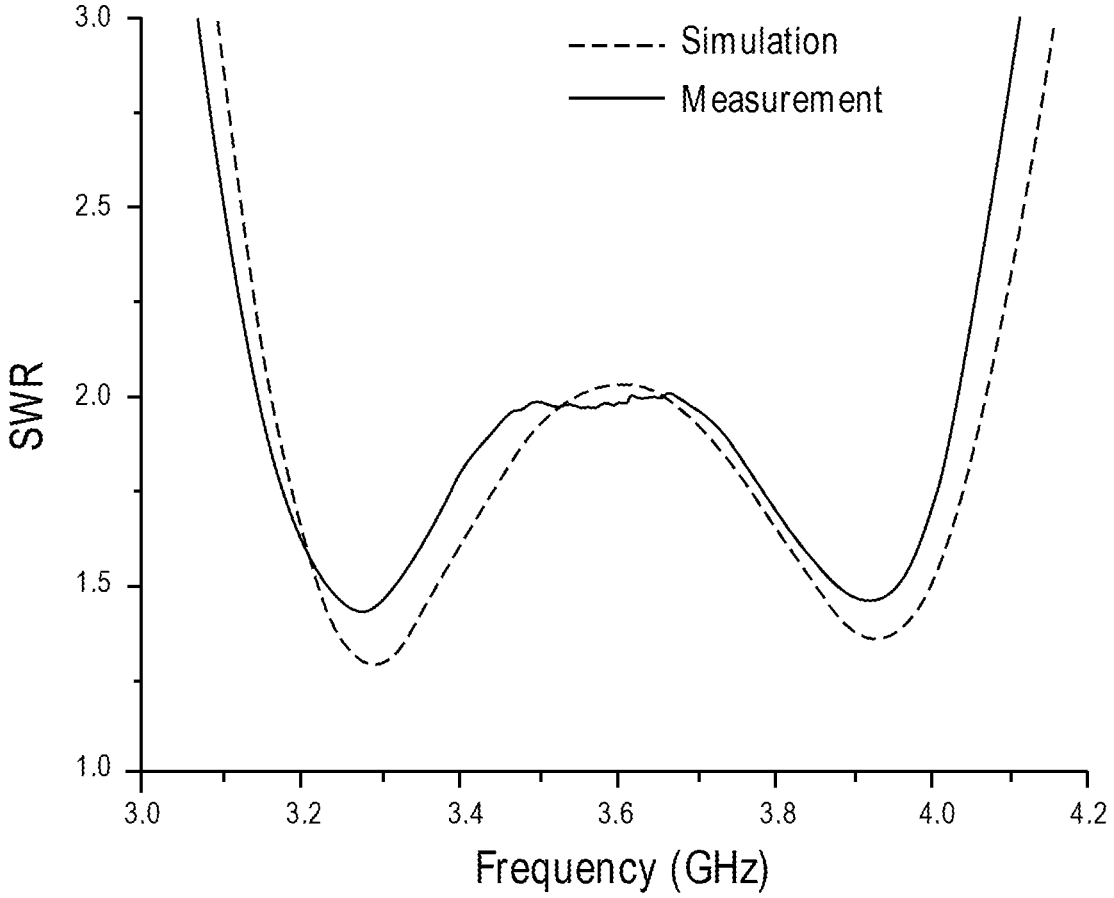
FIG. 2 is a standing wave ratio (SWR) versus frequency chart showing simulated and measured results of the antenna of FIG. 1A.
Figure 3:
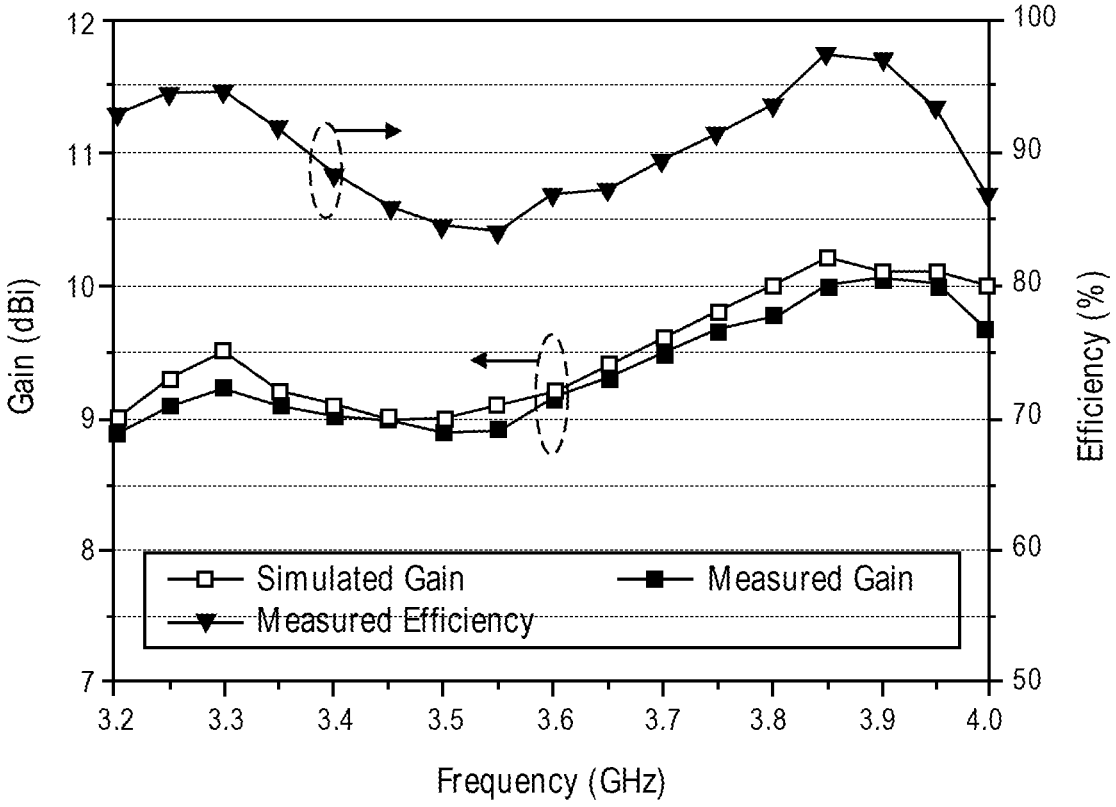
FIG. 3 is a gain and efficiency versus frequency chart for the antenna of FIG. 1A.

FIGS. 2-3 are charts showing measured, empirical data from the patch antenna of FIG. 1 along with simulation data.

The tested patch antenna was $0.39\lambda_0 \times 0.39\lambda_0 \times 0.079\lambda_0$, inset 132 was $0.04\lambda_0$, coil axis height 124 was $0.03\lambda_0$, coil radius 127 of $0.01\lambda_0$, wire diameter 128 was $0.01\lambda_0$, and coil pitch 126 was $0.03\lambda_0$. $\lambda_0$ was between 3.15 GHz and 4.05 GHz. The ground plane measured $1.4\lambda_0 \times 1.4\lambda_0$.

FIG. 2 shows good agreement between the HFSS electromagnetic modeling simulation and the measured results for the standing wave ratio (SWR) versus frequency. The bandwidth for SWR<2 is about 25%, which spans from 3.15 GHz to 4.05 GHz.

FIG. 3 shows that the measured average gain of the antenna is about 9.5 dBi, and the measured maximum gain is about 10 dBi. The measured average radiation efficiency of the linearly polarized patch antenna is better than 85%.

Figure 4:
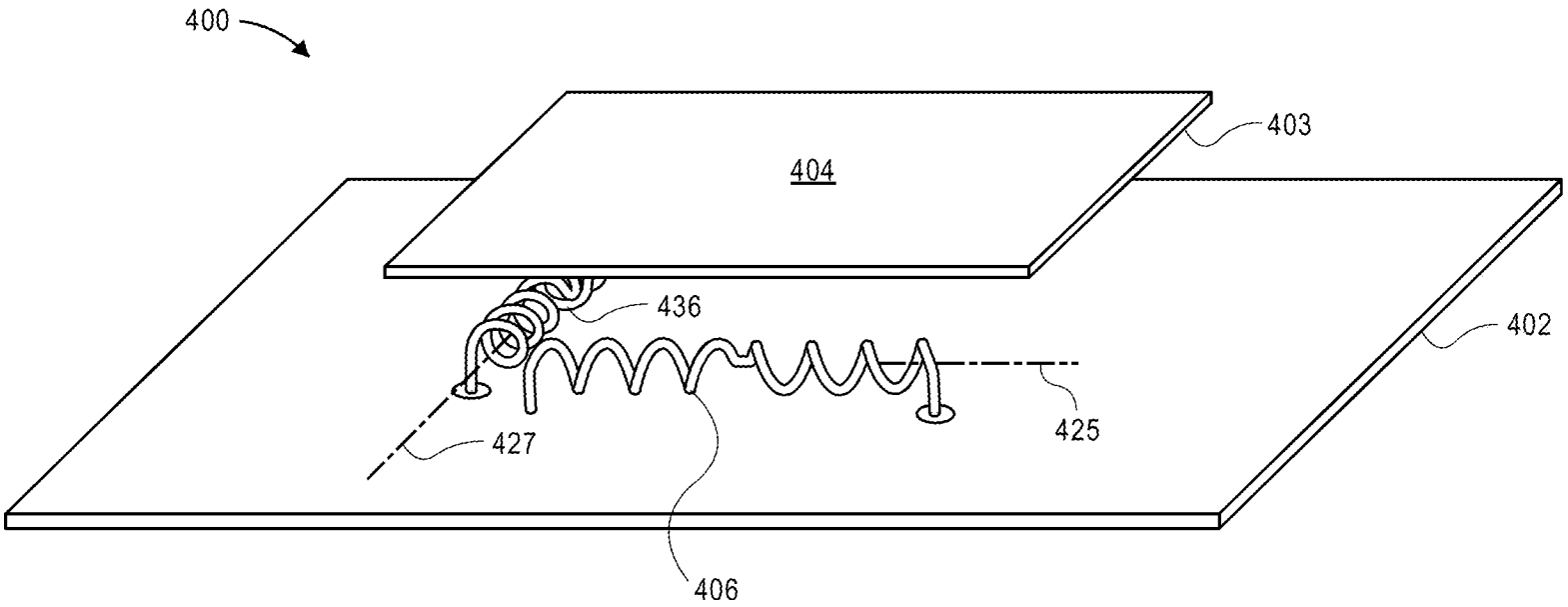
FIG. 4 is an isometric view of a dual polarized patch antenna in accordance with an embodiment.

FIG. 4 illustrates dual linearly polarized patch antenna 400 with two double torsion coil feeding structures. The coils placed perpendicularly with respect to each other results in the dual polarization. For clarity in the figure, no physical supports for the patch are shown.

Like double torsion coil 406, with its axis 425 parallel to ground plane 402, double torsion coil 436's axis 427 is parallel to ground plane 402. Axes 425 and 427 are perpendicular to each other. The orthogonal coils drive rectangular patch 403, having top face 404, with driving magnetic current dipoles with complementary polarizations.

Simulated and measured antenna gains and measured radiation efficiencies of both ports of a prototype based on the embodiment in the figure show that antenna gain varies from 9 dBi to 10 dBi within the impedance bandwidth. The measured radiation efficiency of the dual linearly polarized prototype antenna is better than 90%.

Figure 5:
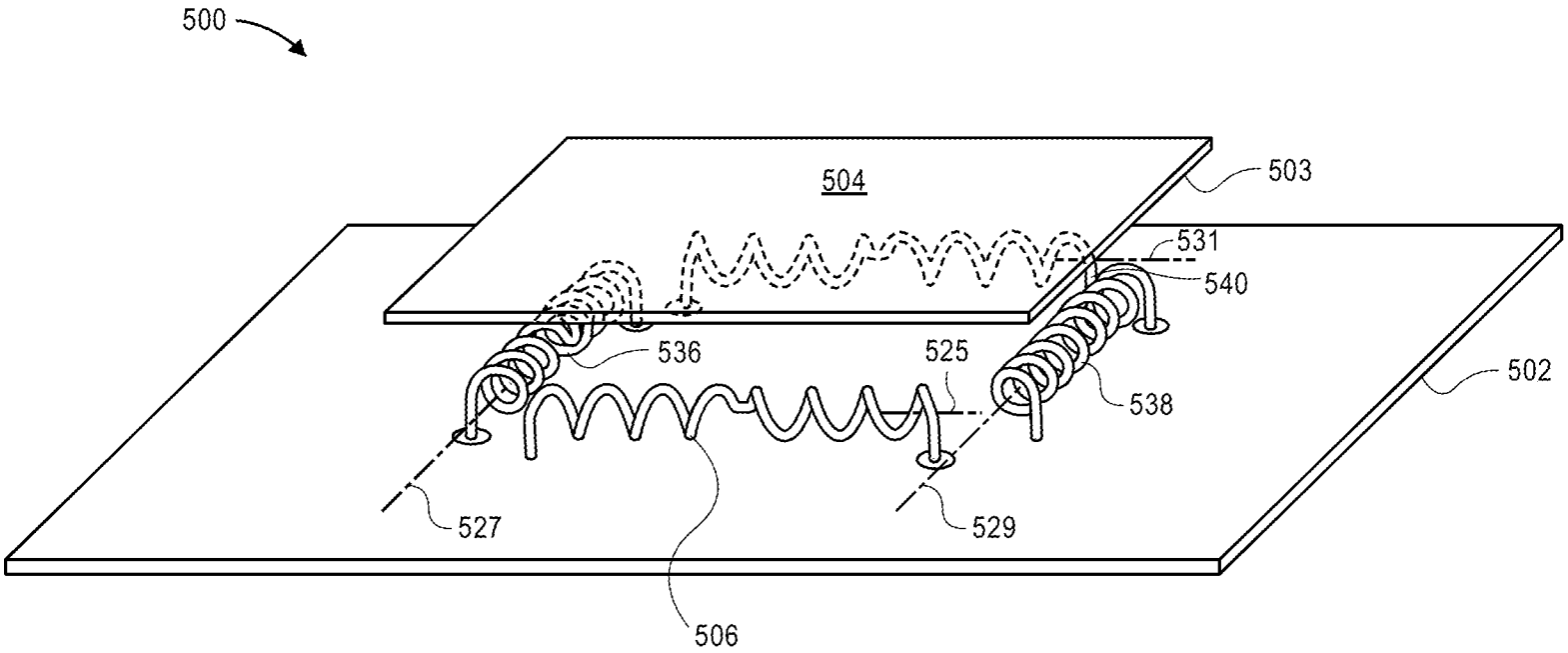
FIG. 5 is an isometric view of a dual polarized, differentially-fed dual polarized patch antenna in accordance with an embodiment.

FIG. 5 is an isometric view of a dual polarized, differentially-fed dual polarized patch antenna 500. Having coils placed perpendicularly to each other results in the dual polarization, while the parallel coils opposite each other offer differential feeding. That is, differential voltages are applied across the parallel coils for differential feeding.

Across the patch from double torsion coil 506 is double torsion coil 540. Double torsion coil 540 is essentially a 180° rotated version of double torsion coil 506. Their axes, axis 525 for double torsion coil 506 and axis 531 for double torsion coil 540, are parallel to each other. These coils form a differential feed pair 506/540.

Perpendicular to differential feed pair 506/540 is a second differential feed pair 536/538, comprising double torsion coil 536 sitting across from double torsion coil 538. Axis 527 for double torsion coil 536 is parallel to axis 529 of double torsion coil 538. Double torsion coil 538 is essentially a 180° rotated version of double torsion coil 536.

The first differential feed pair 506/540 drives one polarization, while the perpendicular differential feed pair 536/538 drives another polarization in patch 503, which has top face 504. Driving magnetic current dipoles from the pairs of double torsion coils appear as such in the otherwise free space between patch 503 and ground plane 502.

The excitation port of double torsion coil 506 can be labeled port 1+, and the excitation port of double torsion coil 540 can be labeled port 1−. Similarly, the excitation port of double torsion coil 536 can be labeled port 2+, and the excitation port of double torsion coil 538 can be labeled port 2−. Ports 1+ and 1− can be supplied from a power divider, with the same magnitude but opposite phases, and ports 2+ and 2− can be supplied from another power divider. With the differential feeding scheme, isolation between the different ports and the distortion of the radiation pattern can be improved from that of non-differentially fed antennas.

Figure 6:
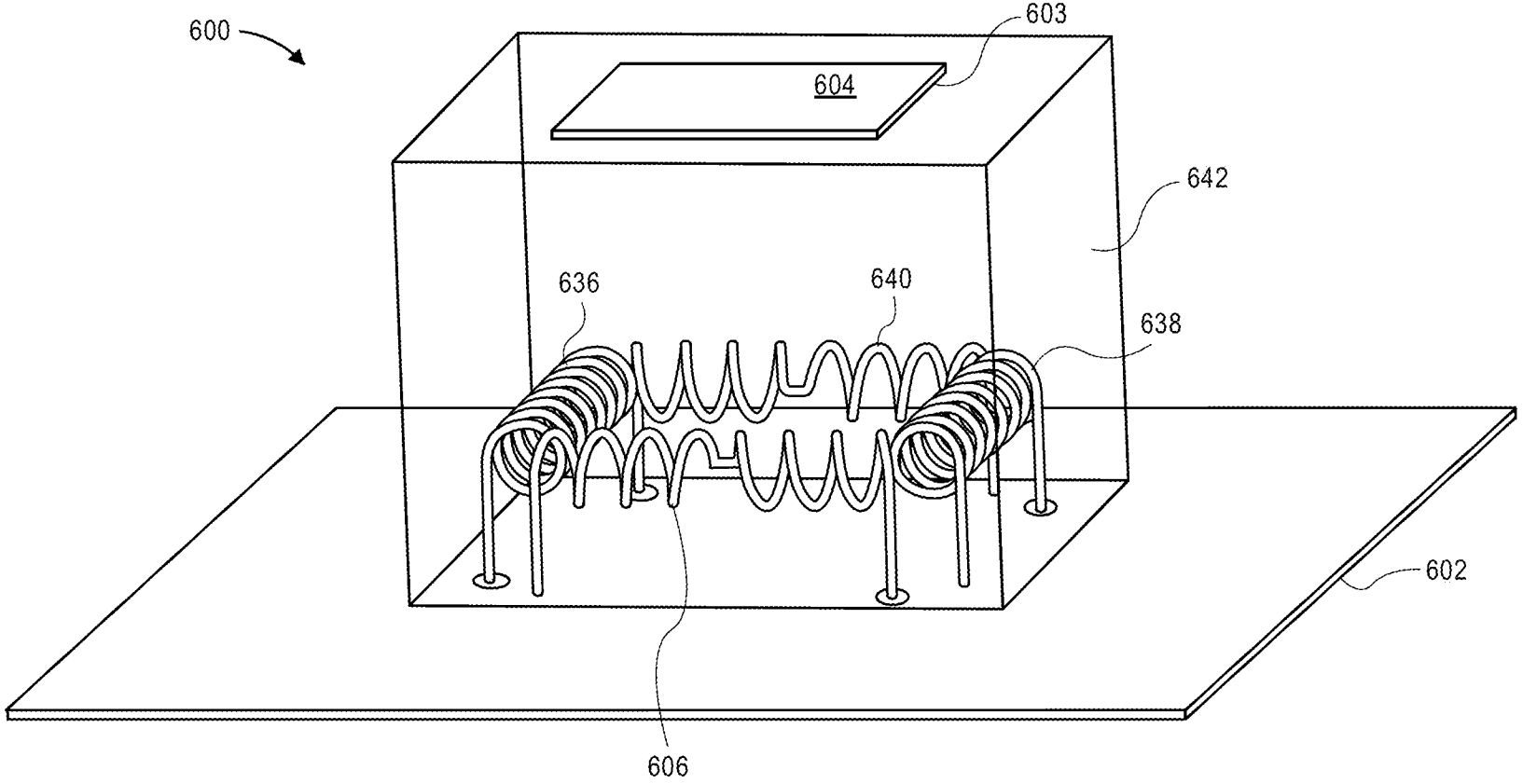
FIG. 6 is an isometric view of a differentially-fed dual polarized patch antenna with dielectric loading in accordance with an embodiment.

FIG. 6 illustrates differentially-fed dual polarized patch antenna 600 with dielectric loading. To make an antenna compact, rectangular metal patch 603, with top face 604, is adhered on the top surface of dielectric block 642. Dielectric block 642 is fastened to ground plane 602. Due to the high permittivity of the dielectric material, the physical size of the antenna is significantly reduced with respect to an air space. This monoblock antenna configuration may be particularly suitable for mass production and installation. For example, K9 glass may be used for dielectric loading to make the antenna strong and compact.

Two pairs of double torsion coils are embedded within dielectric block 642. Double torsion coil 606 is positioned opposite, or on an opposing side of, patch 603 from double torsion coil 640. Double torsion coil 636 is positioned opposite that of double torsion coil 640. Each double torsion coil and its parallel companion positioned opposite the patch are a differential feed pair.

Differential feed pair 606/640 and differential feed pair 636/638 are within the dielectric block but positioned slightly beyond the extents of the patch above. That is, they have a negative offset underneath the patch. In some configurations, the differential feed pairs can have a positive offset underneath the patch.

Figure 7:
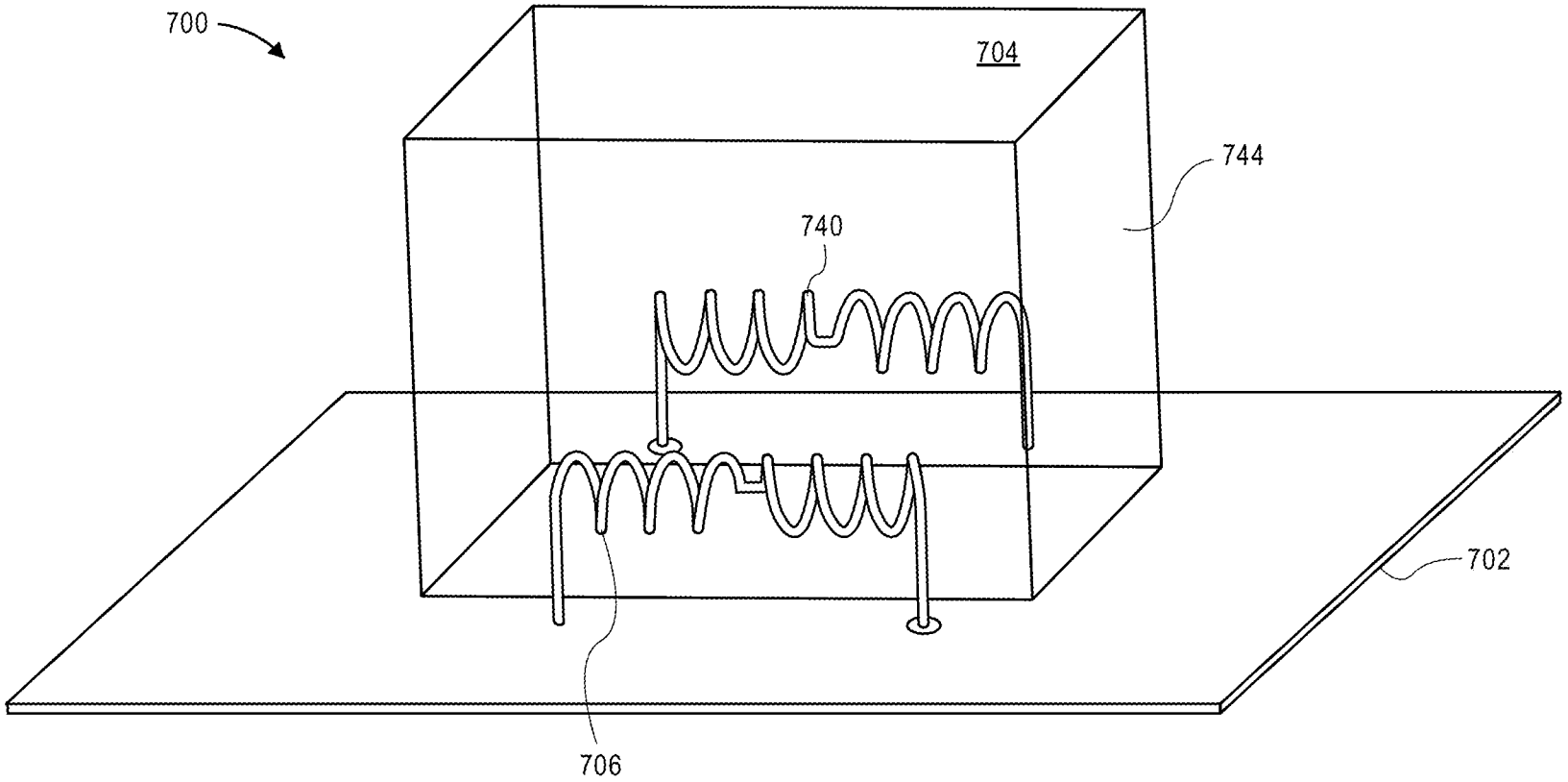
FIG. 7 is an isometric view of a differentially-fed linear dielectric resonator antenna in accordance with an embodiment.

FIG. 7 illustrates differentially-fed linear dielectric resonator antenna 700. Assembly 700 comprises rectangular dielectric block 744 and a pair of double torsion coils 706 and 740. Rectangular dielectric block 744 sits on ground plane 702 and has top face 704. Double torsion coils 706 and 740 are positioned opposite each other across the center of the block and outside of the block.

In this embodiment, double torsion coils play at least two roles: 1) to realize a magnetic dipole, and 2) to excite an electric dipole inside the dielectric resonator. The electric and magnetic dipoles are polarized perpendicularly. With an appropriate weighting of the strength of the electric and magnetic dipoles, the backward radiated electric fields from the two dipoles can be canceled each other, whereas the forwarded radiated electric fields are superposed in phase, leading to a broadside radiation pattern with low backward radiation.

Figure 8:
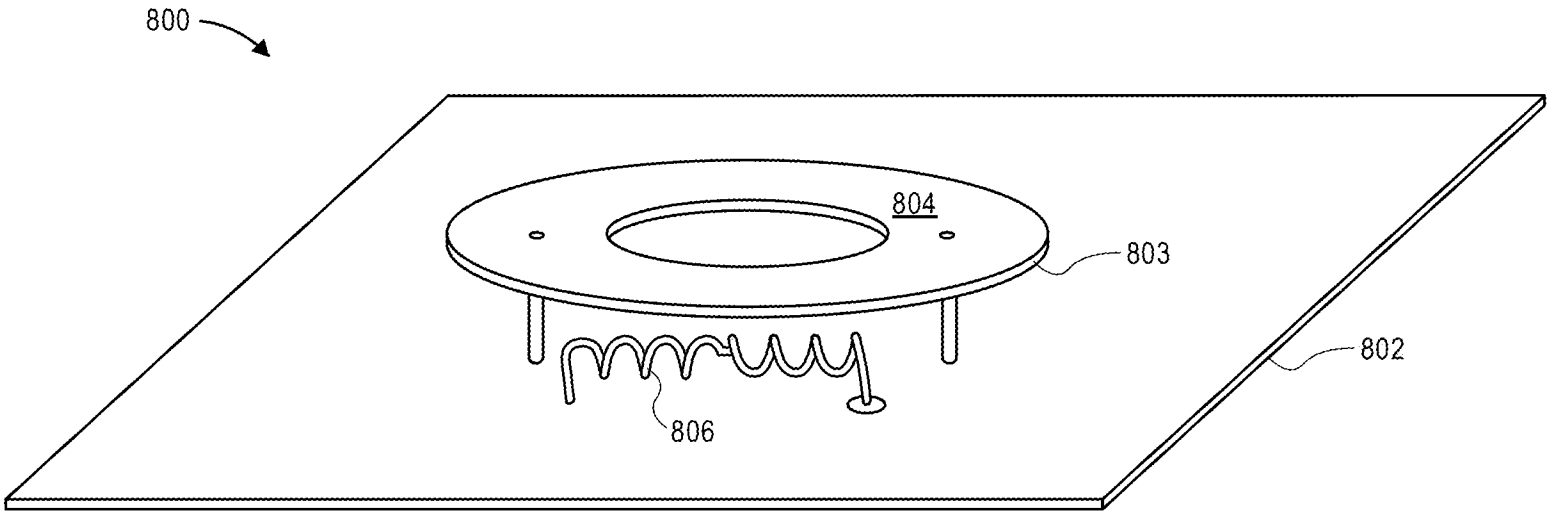
FIG. 8 is an isometric view of a single-fed linearly polarized annular ring patch antenna in accordance with an embodiment.

FIG. 8 is an isometric view of single-fed linearly polarized annular ring patch antenna 800. The assembly includes conductive annular disc 803, with top face 804, and one double torsion coil 806. Annular disc 803 is supported at a fixed height above ground plane 802. Double torsion coil 806 is underneath one side of the double torsion coil and excites the annular ring antenna with a magnetic current dipole that is parallel to the ring and ground plane.

Figure 9:
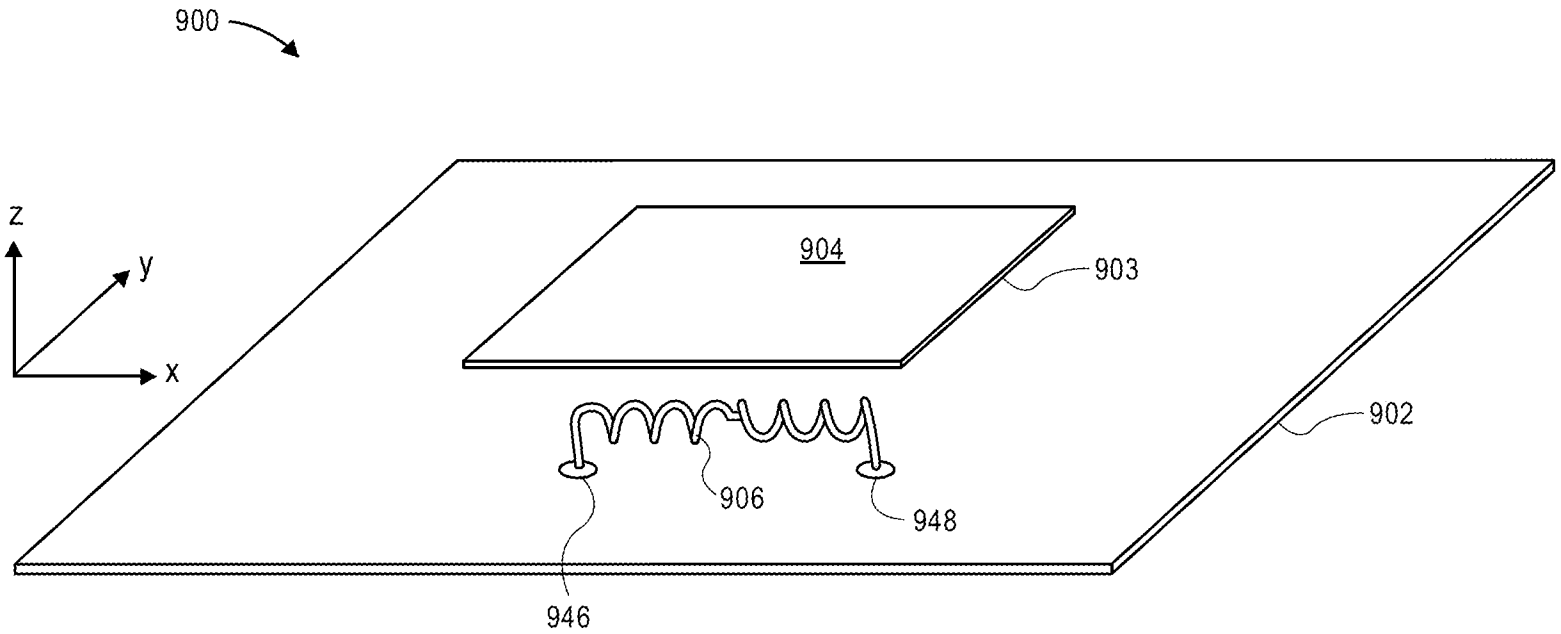
FIG. 9 is an isometric view of a dual-feed double torsion coil antenna in accordance with an embodiment.

FIG. 9 illustrates dual-feed double torsion coil antenna 900 in which both ends are subject to excitation, as opposed to having one end grounded. Conductive patch 903, with top face 903, is supported above ground plane 902. The supports are not shown in the figure for clarity. Double torsion coil 906 is inset a little bit underneath one side of patch 903.

End 946 is connected with an excitation source, and so is opposite end 948. Both ends of the helix/coil are turned down to pass through the through holes in ground plane 902. At the opposite side of ground plane 902, they are connected with an equal power divider network.

"Passing" an object to an opposite side includes running, extending, or inserting through a hole or positioning around an edge such that at least a portion of the object is accessible on the opposite side, or as otherwise known in the art.

Figure 10:
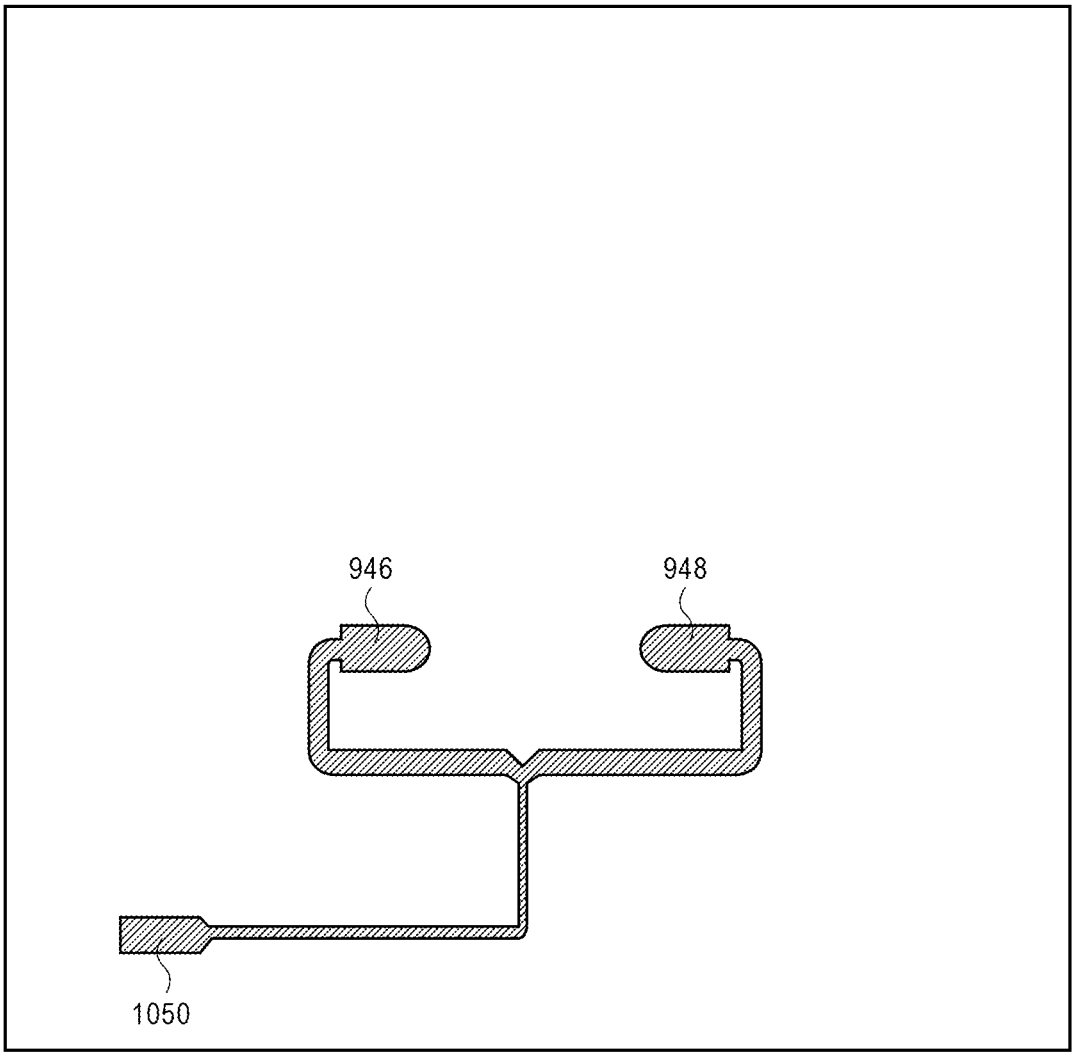
FIG. 10 is a schematic of an equal power divider network for the dual-feed double torsion coil of FIG. 9.

FIG. 10 is a schematic of an equal power divider network for the dual-feed double torsion coil of FIG. 9. One port 1050 drives both end 946 and end 948 with equal magnitude and identical voltages. The performance of the patch antenna fed at two ends is similar to that fed at one end of double torsion coil with the other terminal grounded. However, the structure for dual-feed double torsion coils is more complex than that of a single end feed double torsion coil antenna.

Figure 11:
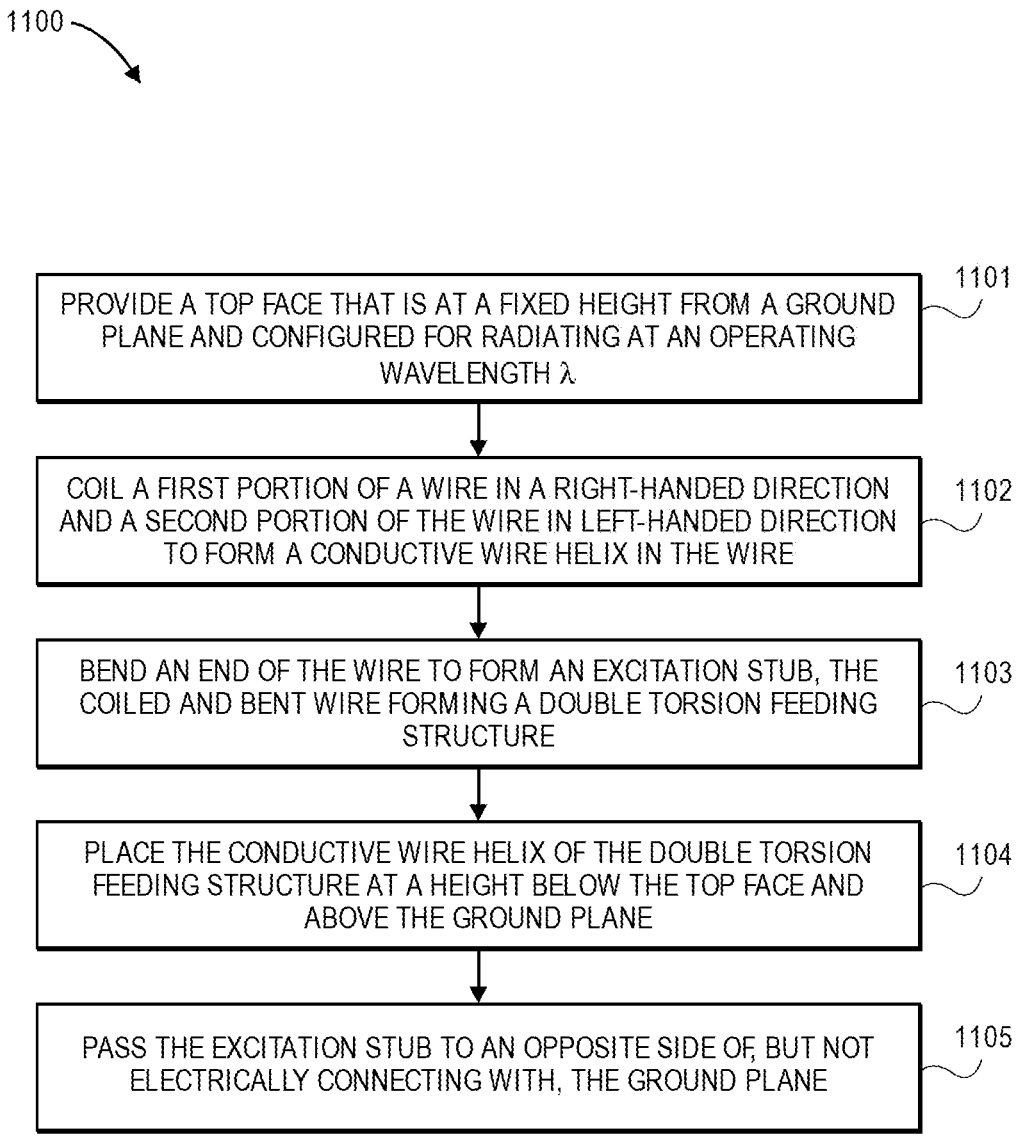
FIG. 11 is a flowchart illustrating a process according to an embodiment of the present disclosure.

FIG. 11 is a flowchart of process 1100 in accordance with an embodiment. In operation 1101, a top face is provided at a fixed height from a ground plane and configured for radiating at an operating wavelength λ. In operation 1102, a first portion of a wire is coiled in a right-handed direction, and a second portion of a wire is coiled in a left-handed direction to form a conductive wire helix in the wire. In operation 1103, an end of the wire is bent to form an excitation stub, the coiled and bent wire forming a double torsion feeding structure. In operation 1104, the conductive wire helix of the double torsion feeding structure is placed at a height below that of the top face and above the ground plane. In operation 1105, the excitation stub is passed to an opposite side of, but not electrically connecting with, the ground plane.

Figure 12:
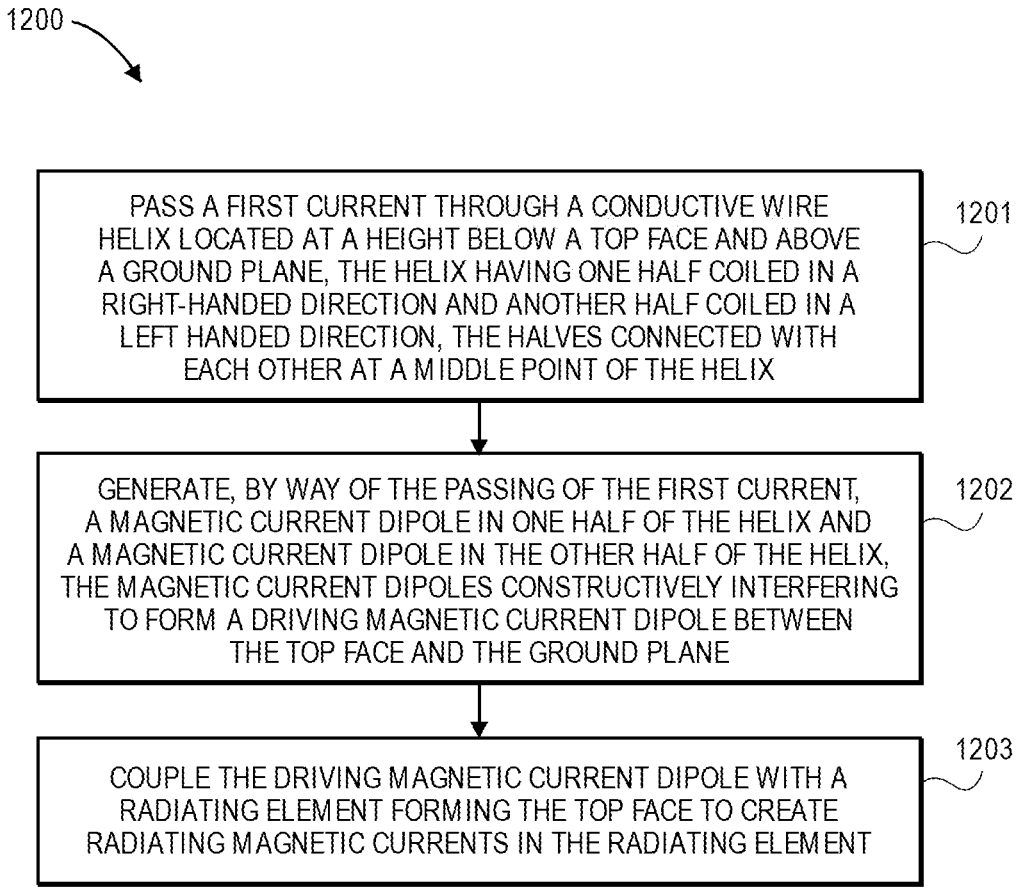
FIG. 12 is a flowchart illustrating a process according to an embodiment of the present disclosure.

FIG. 12 is a flowchart of process 1200 in accordance with an embodiment. In operation 1201, a first current is passed through a conductive wire helix located at a height below a top face and above a ground plane, the helix having one half coiled in a right-handed direction and another half coiled in a left-handed direction, the halves connected with each other at a middle point of the helix. In operation 1202, a magnetic current dipole is generated in one half of the helix and a magnetic current dipole is generated in the other half of the helix by way of passing of the first current. The magnetic current dipoles constructively interfere to form a driving magnetic current dipole between the top face and the ground plane. In operation 1203, the driving magnetic current dipole is coupled with a radiating element forming the top face to create radiating magnetic currents in the radiating element.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. An antenna apparatus having a magnetic-current feeding structure, the apparatus comprising:

a ground plane;

a top face at a fixed height from the ground plane and configured for radiating at an operating wavelength λ;

a conductive wire helix having an axis parallel with the ground plane, the helix located at a height below the top face and above the ground plane, the helix having one half coiled in a right-handed direction and another half coiled in a left-handed direction, the halves connected with each other at a middle point of the helix; and an excitation stub connected with an end of the conductive wire helix, the excitation stub configured for connecting with an excitation source.

2. The apparatus of claim 1 further comprising:

a ground stub connecting an end of the conductive wire helix that is opposite the excitation stub to the ground plane.

3. The apparatus of claim 1 further comprising:

a dual feed stub that is configured to connect an end of the conductive wire helix that is opposite the excitation stub with the excitation source.

4. The apparatus of claim 1 wherein the conductive wire helix is a first conductive wire helix of a differential feed pair, the apparatus further comprising:

a differential conductive wire helix having an axis parallel with the ground plane and parallel to the axis of the first conductive wire helix, the differential helix having one half coiled in a right-handed direction and another half coiled in a left-handed direction, the halves of the differential helix connected with each other at a middle point of the differential helix.

5. The apparatus of claim 4 wherein the first conductive wire helix and the differential conductive wire helix form a first differential feed pair, the apparatus further comprising:

a perpendicular differential feed pair comprising a pair of conductive wire helixes each having an axis parallel with the ground plane and perpendicular to the axis of the first conductive wire helix, each having one half coiled in a right-handed direction and another half coiled in a left-handed direction.

6. The apparatus of claim 1 wherein the conductive wire helix is a first conductive wire helix of a dual polarized feed, further comprising:

a perpendicular conductive wire helix having an axis parallel with the ground plane and perpendicular to the axis of the first conductive wire helix, the perpendicular helix having one half coiled in a right-handed direction and another half coiled in a left-handed direction, the halves of the perpendicular helix connected with each other at a middle point of the perpendicular helix.

7. The apparatus of claim 1 further comprising:

a rectangular or square conductive patch, wherein the top face is a surface of the conductive patch.

8. The apparatus of claim 7 wherein the helix axis is parallel with a straight edge of the patch.

9. The apparatus of claim 7 further comprising:

a dielectric block extending from the ground plane to the conductive patch.

10. The apparatus of claim 9 wherein the conductive wire helix is embedded within the dielectric block.

11. The apparatus of claim 1 further comprising:

a conductive annular ring, wherein the top face is a surface of the conductive annular ring.

12. The apparatus of claim 11 further comprising:

a dielectric block extending from the ground plane to the conductive annular ring.

13. The apparatus of claim 1 further comprising:

a dielectric resonator, wherein the top face is a surface of the dielectric resonator.

14. The apparatus of claim 1 wherein a height of the helix axis above the ground plane is less than 0.04λ.

15. The apparatus of claim 1 wherein a number of turns N of each half of the conductive wire helix is 2, 2½, 3, 3½, 4, 4½, or 5.

16. The apparatus of claim 1 wherein a radius b of the conductive wire helix is less than 0.01λ.

17. The apparatus of claim 1 further comprising:

an excitation source connected with the excitation stub.

18. An array of antenna apparatuses of claim 1.

19. A method of manufacturing an antenna apparatus having a magnetic-current feeding structure, the method comprising:

providing a top face that is at a fixed height from a ground plane and configured for radiating at an operating wavelength λ;

coiling a first portion of a wire in a right-handed direction and a second portion of the wire in left-handed direction to form a conductive wire helix in the wire;

bending an end of the wire to form an excitation stub, the coiled and bent wire forming a double torsion feeding structure;

placing the conductive wire helix of the double torsion feeding structure at a height below the top face and above the ground plane; and passing the excitation stub to an opposite side of, but not electrically connecting with, the ground plane.

20. A method of magnetically feeding an antenna having a nominal operating wavelength of λ, the method comprising:

passing a current through a conductive wire helix located at a height below a top face and above a ground plane, the helix having one half coiled in a right-handed direction and another half coiled in a left handed direction, the halves connected with each other at a middle point of the helix;

generating, by way of the passing of the current, a magnetic current dipole in one half of the helix and a magnetic current dipole in the other half of the helix, the magnetic current dipoles constructively interfering to form a driving magnetic current dipole between the top face and the ground plane; and coupling the driving magnetic current dipole with a radiating element forming the top face to create radiating magnetic currents in the radiating element.

* * * * *